US010311771B2

(12) United States Patent
Xiao

(10) Patent No.: US 10,311,771 B2
(45) Date of Patent: Jun. 4, 2019

(54) DISPLAY DEVICE, IMAGE DATA PROCESSING APPARATUS AND METHOD

(71) Applicant: EVERDISPLAY OPTRONICS (SHANGHAI) LIMITED, Shanghai (CN)

(72) Inventor: Lina Xiao, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 407 days.

(21) Appl. No.: 15/149,307

(22) Filed: May 9, 2016

(65) Prior Publication Data

US 2017/0178554 A1 Jun. 22, 2017

(30) Foreign Application Priority Data

Dec. 16, 2015 (CN) ..... 2015 1 0947129

(51) Int. Cl.
*G09G 5/02* (2006.01)
*G09G 3/20* (2006.01)
(Continued)

(52) U.S. Cl.
CPC ..... *G09G 3/2074* (2013.01); *G09G 3/2003* (2013.01); *G09G 3/3208* (2013.01); *G09G 3/3275* (2013.01); *G09G 2300/0452* (2013.01)

(58) Field of Classification Search
CPC .. G09G 3/2074; G09G 3/2003; G09G 3/3208; G09G 3/3275
(Continued)

(56) References Cited

U.S. PATENT DOCUMENTS 4,969,718 A * 11/1990 Noguchi ..... G02F 1/133514 345/88
2008/0101717 A1* 5/2008 Ho ..... G06T 5/003 382/266
(Continued)

FOREIGN PATENT DOCUMENTS

CN 1967635 A 5/2007
CN 102496354 A 6/2012
(Continued)

OTHER PUBLICATIONS

The CN1OA issued Apr. 4,2019 by the CNIPA.

*Primary Examiner* — Jonathan M Blancha
(74) *Attorney, Agent, or Firm* — Yunling Ren

(57) ABSTRACT

The present disclosure provides a display device, and an image data processing apparatus and method. The image data processing apparatus is applied in a pixel matrix, and includes: an edge detecting module, configured to receive to-be-displayed image data in the pixel matrix, and perform edge detection on the to-be-displayed image data to acquire edge pixels located at an edge of a predetermined type; a subpixel selecting module, configured to judge whether the first and second subpixels in the edge pixels are located on an even more outer side at the edge of the predetermined type relative to the third subpixel, and select the first and second subpixels located on the even more outer side at the edge of the predetermined type relative to the third subpixel as to-be-adjusted subpixels; a luminance attenuating module, configured to perform luminance attenuation on the to-be-adjusted subpixels; and a data transmitting module.

17 Claims, 12 Drawing Sheets

(51) Int. Cl.
*G09G 3/3208* (2016.01)
*G09G 3/3275* (2016.01)

(58) Field of Classification Search
USPC ..... 345/694
See application file for complete search history.

(56) References Cited

U.S. PATENT DOCUMENTS

2011/0254884 A1* 10/2011 Cho ..... G09G 3/3648 345/691
2014/0078170 A1* 3/2014 Ohki ..... G06T 11/001 345/606

FOREIGN PATENT DOCUMENTS

CN 104461440 A 3/2015
CN 105046671 A 11/2015
JP 2013015680 A 1/2013

* cited by examiner

| | | |
|---|---|---|
| -1 | 0 | 1 |
| -2 | 0 | 2 |
| -1 | 0 | 1 |

FIG. 6A

| | | |
|---|---|---|
| 1 | 2 | 1 |
| 0 | 0 | 0 |
| -1 | -2 | -1 |

FIG. 6B

DISPLAY DEVICE, IMAGE DATA PROCESSING APPARATUS AND METHOD

CROSS-REFERENCE TO RELATED APPLICATIONS

The present application is based upon and claims priority to Chinese Patent Application No. 201510947129.8, filed Dec. 16, 2015, the entire contents of which are incorporated herein by reference.

TECHNICAL FIELD

The present disclosure relates to the field of display technologies, and particularly, to an image data processing apparatus, an image data processing method, and a display device including the image data processing apparatus.

BACKGROUND

With the development of the optical technology and semiconductor technology, liquid crystal display (LCD) panels and organic light-emitting diode (OLEDs) display panels and the like have been widely applied in various electronic products. Depending on subpixel arrangements, the LCD and OLED display panels may involve strip-like arrangement, delta-like arrangement and other arrangements.

As illustrated in FIG. 1, a schematic structural diagram of a display panel in a strip-like arrangement is shown. In such a display panel, each pixel includes a red (R) subpixel, a green (G) subpixel and a blue (B) subpixel located in the same row. Different luminance is generated by the subpixels in the three colors in each pixel, and thus different colors may be formed through mixture.

As illustrated in FIG. 2, a schematic structural diagram of a display panel in a delta-like arrangement is shown. In such a display panel, each pixel includes: subpixels in two colors in the same row, for example, a red (R) subpixel and a green (G) subpixel; and a subpixel in a third color located in an adjacent row, for example, a blue (B) subpixel. That is, the subpixels in the three colors in the pixel are in delta-like arrangement. Different luminance is generated by the subpixels in the three colors in the delta arrangement, and thus different colors may be formed through mixture.

Currently, wearable smart devices are gradually prevailing. In a wearable smart device such as a smart watch, the watch panel is mostly displayed, and clock digits and clock pointers are displayed in the image of the watch panel. In this case, a strict requirement is imposed on the digits and oblique display effect of the display panel. However, referring to FIG. 3A and FIG. 3B, using the digit "1" as an example, FIG. 3A illustrates to-be-displayed image data, and FIG. 3B illustrates an actual displayed image of the to-be-displayed image data of FIG. 3A on a display panel in delta-like arrangement; and it may be seen that edges of the image are subjected to a sense of unsmooth burrs, and as a result the image display quality is degraded and the user experience is affected.

SUMMARY

The present disclosure is intended to provide an image data processing apparatus, an image data processing method and a display device including the image data processing apparatus, to overcome at least to some extent one or more problems caused due to restrictions and defects in the related art.

Other characteristics, features, and advantages of the present disclosure will become obvious through the following detailed descriptions, or are partially learned from practice of the present disclosure.

According to a first aspect of the present disclosure, an image data processing apparatus is provided, which is applied in a pixel matrix, each pixel in the pixel matrix including a first subpixel and a second subpixel located in a first subpixel row and a third subpixel located in a second subpixel row, each of the first subpixel row and second subpixel row being formed by first to third subpixels aligned repeatedly; wherein the image data processing apparatus includes:

an edge detecting module, configured to receive to-be-displayed image data in the pixel matrix, and perform edge detection on the to-be-displayed image data to acquire edge pixels located at an edge of a predetermined type;

a subpixel selecting module, configured to judge whether the first and second subpixels in the edge pixels are located on an even more outer side at the edge of the predetermined type relative to the third subpixel, and select the first and second subpixels located on the even more outer side at the edge of the predetermined type relative to the third subpixel as to-be-adjusted subpixels;

a luminance attenuating module, configured to perform luminance attenuation on the to-be-adjusted subpixels according to a predetermined luminance attenuation coefficient, to obtain to-be-transmitted image data; and a data transmitting module, configured to transmit the to-be-transmitted image to a source driver.

In an exemplary embodiment of the present disclosure, the edge of the predetermined type is an edge parallel to an extension direction of the first and second subpixel rows.

In an exemplary embodiment of the present disclosure, in a pixel in the $m^{th}$ row and the $n^{th}$ column in the pixel matrix, the first and second subpixels are located in the $2m-1^{th}$ subpixel row, and the third subpixel is located in the $2m^{th}$ subpixel row; in a pixel in the $m^{th}$ row and $n+1^{th}$ column in the pixel matrix, the first and second subpixels are located in the $2m^{th}$ subpixel row, and the third subpixel is located in the $2m-1^{th}$ subpixel row; and the subpixel selecting module judges, according to positions of the edge pixels in the pixel matrix and the type of the edge where the edge pixels are located, whether the first and second subpixels in the edge pixels are located at the even more outer side at the edge of the predetermined type relative to the third subpixel.

In an exemplary embodiment of the present disclosure, the image data processing apparatus further includes:

a mapping converting module, coupled to the edge detecting module, and configured to receive original image data in strip-like arrangement and convert the original image data into to-be-displayed image data in delta-like arrangement in the pixel matrix.

In an exemplary embodiment of the present disclosure, the edge detecting module employs the Sobel edge detection algorithm or the Roberts Cross edge detection algorithm to perform edge detection on the to-be-displayed image data.

In an exemplary embodiment of the present disclosure, the first subpixel is a red subpixel, the second subpixel is a green subpixel, and the third subpixel is a blue subpixel.

In an exemplary embodiment of the present disclosure, the predetermined luminance attenuation coefficient is positively correlated to a light-emitting efficiency of the first subpixel and the second subpixel and an aperture opening ratio of the first subpixel and the second subpixel.

In an exemplary embodiment of the present disclosure, the predetermined luminance attenuation coefficient is from 20% to 40%.

According to a second aspect of the present disclosure, an image data processing method is provided, which is applied in a pixel matrix, each pixel in the pixel matrix including a first subpixel and a second subpixel located in a first subpixel row and a third subpixel located in a second subpixel row, each of the first subpixel row and second subpixel row being formed by first to third subpixels aligned repeatedly; wherein the image data processing method includes:

step S1: receiving to-be-displayed image data in the pixel matrix, and performing edge detection on the to-be-displayed image data to acquire edge pixels located at an edge of a predetermined type;

step S2: judging whether the first and second subpixels in the edge pixels are located on an even more outer side at the edge of the predetermined type relative to the third subpixel, and selecting the first and second subpixels located on the even more outer side at the edge of the predetermined type relative to the third subpixel as to-be-adjusted subpixels;

step S3: performing luminance attenuation on the to-be-adjusted subpixels according to a predetermined luminance attenuation coefficient, to obtain to-be-transmitted image data; and step S4: transmitting the to-be-transmitted image data to a source driver.

In an exemplary embodiment of the present disclosure, the edge of the predetermined type is an edge parallel to an extension direction of the first and second subpixel rows.

In an exemplary embodiment of the present disclosure, in a pixel in the $m^{th}$ row and the $n^{th}$ column in the pixel matrix, the first and second subpixels are located in the $2m-1^{th}$ subpixel row, and the third subpixel is located in the $2m^{th}$ subpixel row; in a pixel in the $m^{th}$ row and $n+1^{th}$ column in the pixel matrix, the first and second subpixels are located in the $2m^{th}$ subpixel row, and the third subpixel is located in the $2m-1^{th}$ subpixel row; and in the step S2, it is judged, according to positions of the edge pixels in the pixel matrix and the type of the edge where the edge pixels are located, whether the first and second subpixels in the edge pixels are located at the even more outer side at the edge of the predetermined type relative to the third subpixel.

In an exemplary embodiment of the present disclosure, prior to the step S1, the image data processing method further includes:

step S0: receiving original image data in strip-like arrangement and converting the original image data into to-be-displayed image data in delta-like arrangement in the pixel matrix.

In an exemplary embodiment of the present disclosure, in step S1, the Sobel edge detection algorithm or the Roberts Cross edge detection algorithm is employed to perform edge detection on the to-be-displayed image data.

In an exemplary embodiment of the present disclosure, the first subpixel is a red subpixel, the second subpixel is a green subpixel, and the third subpixel is a blue subpixel.

In an exemplary embodiment of the present disclosure, the predetermined luminance attenuation coefficient is positively correlated to a light-emitting efficiency of the first subpixel and the second subpixel and an aperture opening ratio of the first subpixel and the second subpixel.

In an exemplary embodiment of the present disclosure, the predetermined luminance attenuation coefficient is from 20% to 40%.

According to a third aspect of the present disclosure, a display device is provided, which includes any image data processing apparatus as defined above.

In the exemplary embodiments of the present disclosure, the edge pixels located at the edge of the predetermined type in the to-be-displayed image data in delta-like arrangement are extracted, the to-be-adjusted subpixel is selected from the edge pixel, and the luminance of the to-be-adjusted subpixel is adjusted, such that a case where an apparent unsmooth burr sense is caused to the image may be well prevented, and sharpness of image edge display is maintained. In this way, a better display quality is provided.

BRIEF DESCRIPTION OF THE DRAWINGS

Exemplary embodiments of the present disclosure are described in detail with reference to the accompanying drawings, through which the above features and other features and advantages of the present disclosure will become more obvious.

FIG. 6A and FIG. 6B are schematic diagrams of a Sobel template according to an exemplary embodiment of the present disclosure;

Figure 1:
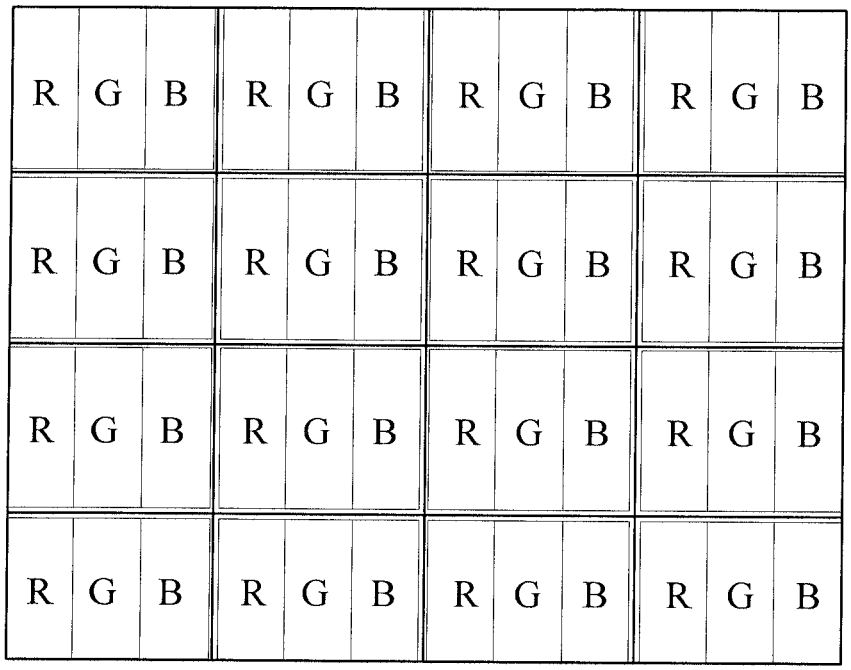
FIG. 1 (Prior Art)
FIG. 1 is a schematic structural diagram of a strip-like display panel in the prior art.
Figure 2:
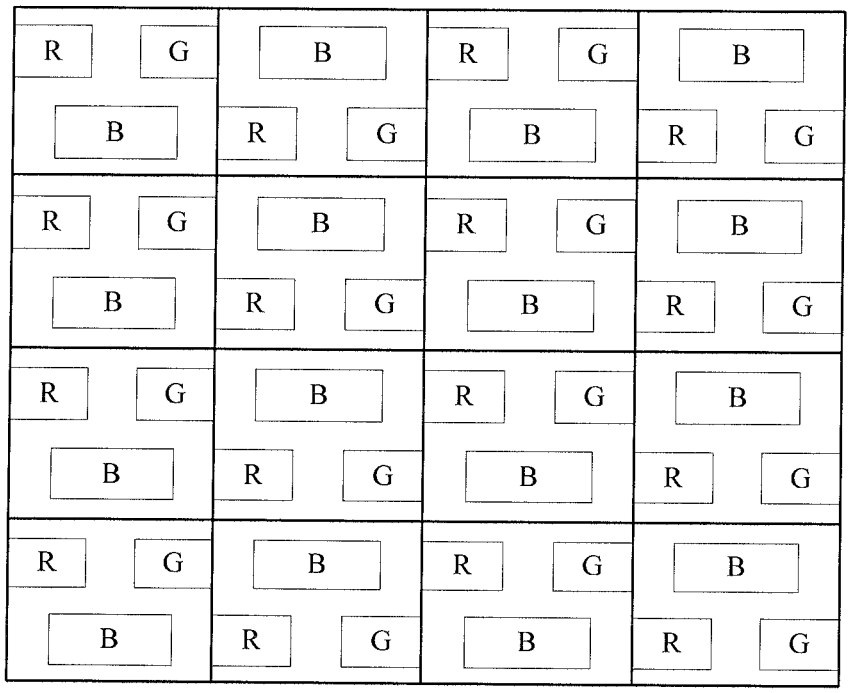
FIG. 2 (Prior Art)
FIG. 2 is a schematic structural diagram of a delta-like display panel in the prior art.

Reference numerals are listed as below:

10 image data processing apparatus
11 mapping converting module
12 edge detecting module
13 subpixel selecting module
14 luminance attenuating module
15 data transmitting module
20 source driver
S0-S4 steps

DETAILED DESCRIPTION

Exemplary embodiments of the present disclosure are hereinafter described in detail with reference to the accompany drawings. However, the exemplary embodiments may be implemented in a plurality of manners, and shall not be construed as being limited to the implementation described herein. On the contrary, such exemplary embodiments more thoroughly and completely illustrate the present disclosure, and convey the concepts of the exemplary embodiments to persons skilled in the art. In the drawings, for clear description, the thicknesses of the areas and layers are enlarged. In the drawings, like reference numerals denote like or similar structures or elements. Therefore, detailed descriptions of these structures or elements are omitted herein.

In addition, the described characteristics, structures, or features may be incorporated in one or more embodiments in any suitable manner. In the description hereinafter, more details are provided such that sufficient understanding of the embodiments of the present disclosure may be achieved. However, a person skilled in the art would be aware that the technical solutions of the present disclosure may be practiced without one or more of the specific details, or may be practiced using other methods, structures, steps or the like. Under other circumstances, commonly known methods, structures or steps are not illustrated or described in detail to avoid incurring aspects of the present disclosure to be blurred.

Figure 3A:
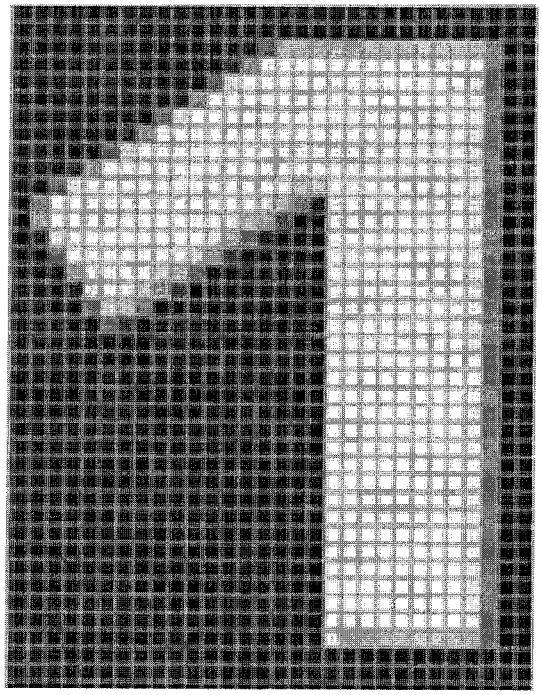
FIG. 3A (Prior Art)
FIG. 3A illustrates to-be-displayed image data.
Figure 3B:
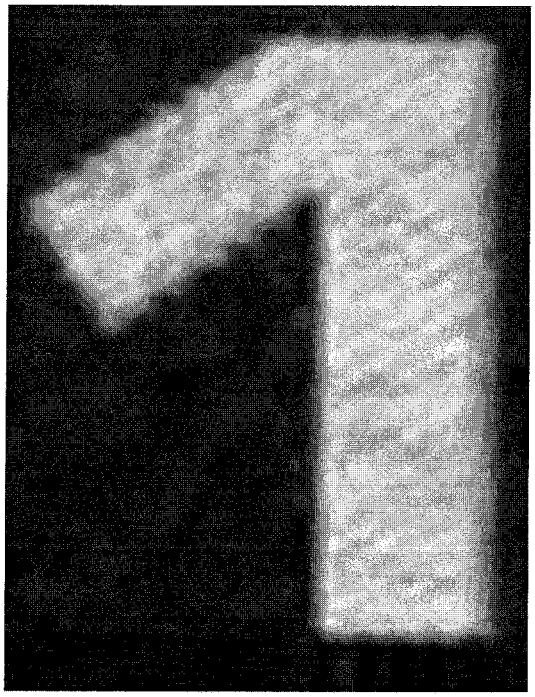
FIG. 3B (Prior Art)
FIG. 3B is an actual displayed image of the to-be-displayed image data of FIG. 3A on a display panel in delta-like arrangement.

The luminance sensitivities of human eyes to green subpixels, red subpixels and blue subpixels are reduced in this order; and in an OLED display panel, the light-emitting efficiencies of the red subpixel and the green subpixel are far greater than the light-emitting efficiency of the blue subpixel. Therefore, as illustrated in FIG. 3A and FIG. 3B, due to restriction on arrangement of the subpixels in the pixel of a display panel in delta-like arrangement, at the edge of an image, particularly at an upper edge, a lower edge and some positions at an oblique edge, extremely apparent red subpixels and green subpixels are prominently displayed. As such, human eyes may apparently sense very unsmooth burrs on the edge of the image.

Figure 4:
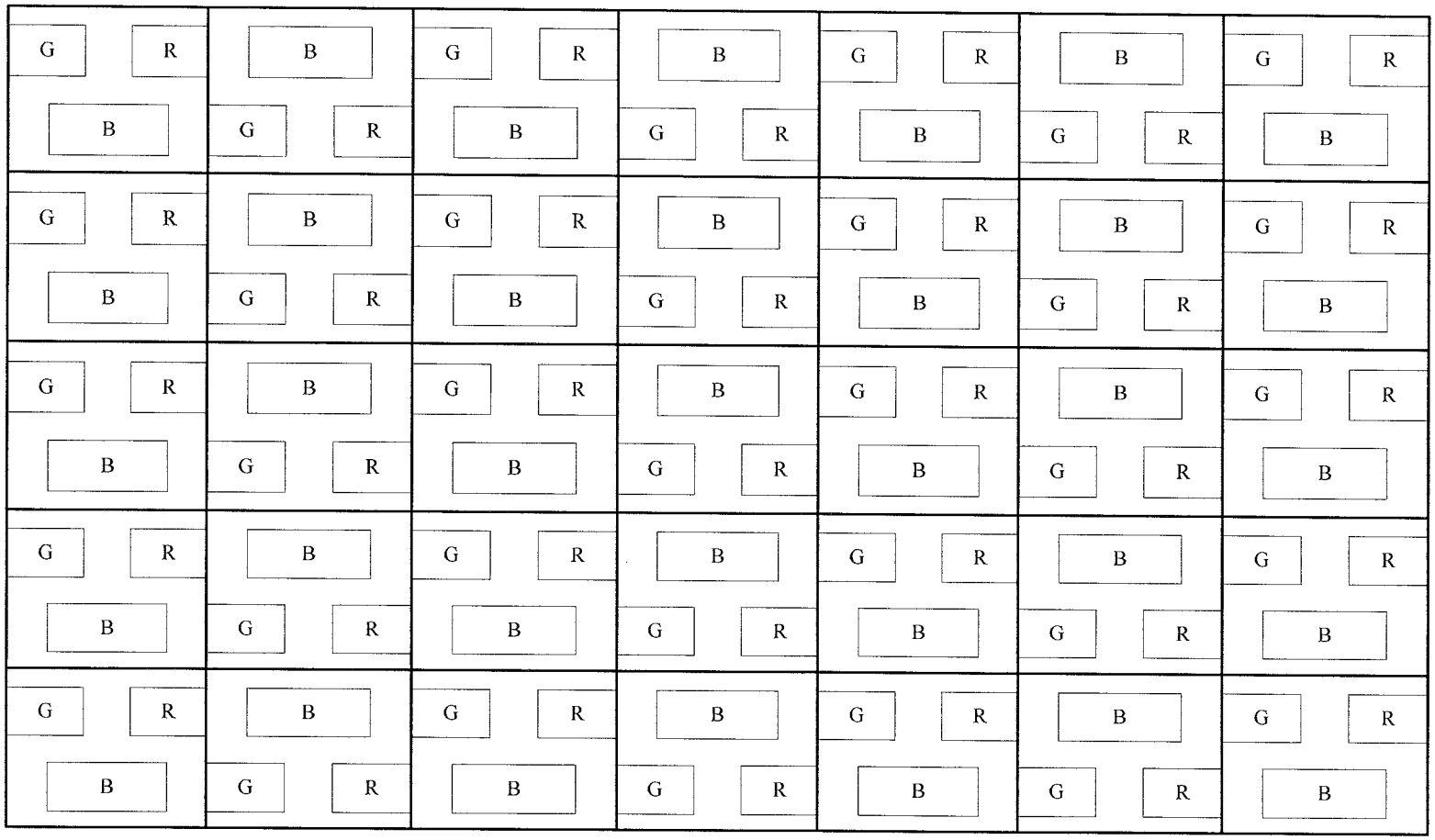
FIG. 4 is a schematic structural diagram of a delta-like display panel according to an exemplary embodiment of the present disclosure.

To overcome the above problem, an image data processing apparatus 10 is firstly provided in an exemplary embodiment of the present disclosure. The image data processing apparatus 10 is mainly applied in a display panel in delta-like arrangement as illustrated in FIG. 4, and the display panel includes a pixel matrix. Each pixel of the pixel matrix includes a first subpixel and a second subpixel located in a first subpixel row and a third subpixel located in a second subpixel row, each of the first subpixel row and second subpixel row being formed by first to third subpixels aligned repeatedly. In FIG. 4, the first subpixel is a red subpixel, the second subpixel is a green subpixel, and the third subpixel is a blue subpixel. However, a person skilled in the art would easily understand that the first subpixel may be a green subpixel, the second subpixel may be a red subpixel, and the third subpixel may be a blue subpixel; or, the first subpixel, the second subpixel and the third subpixel may be subpixels in other colors besides red, green and blue, which is not particularly limited in this exemplary embodiment.

Figure 5:
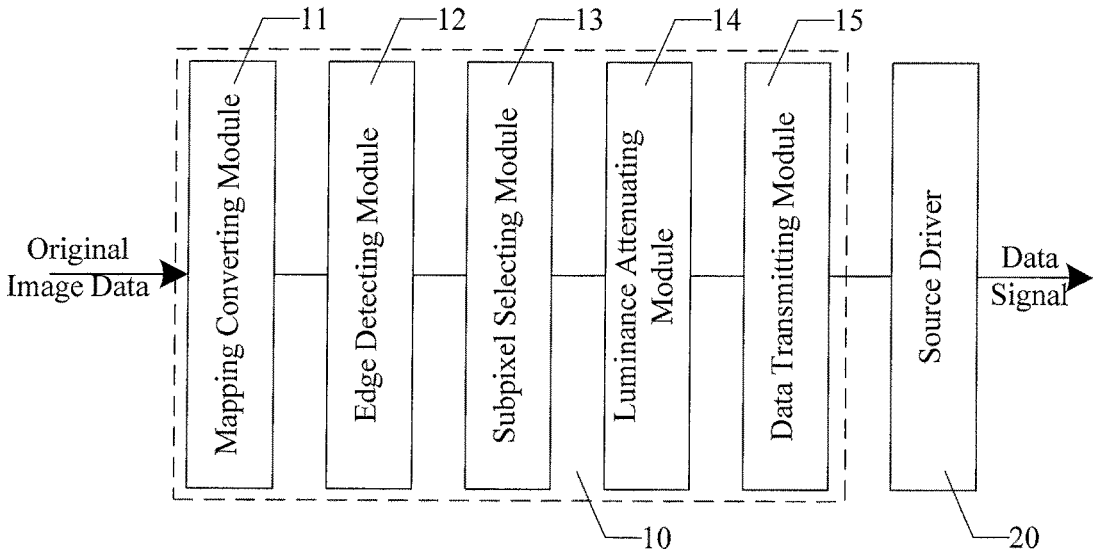
FIG. 5 is a schematic structural diagram of an image data processing apparatus according to an exemplary embodiment of the present disclosure.

Referring to FIG. 5, in this exemplary embodiment, the image data processing apparatus 10 may include an edge detecting module 12, a subpixel selecting module 13, a luminance attenuating module 14, and a data transmitting module 15. Besides, the image data processing apparatus may further include a mapping converting module 11.

The mapping converting module 11 is coupled to the edge detecting module 12, and is mainly configured to receive original image data in strip-like arrangement, and convert the original image data into to-be-displayed image data in delta-like arrangement in the pixel matrix.

Since most original image data is arranged in a strip-like manner, the image data in strip-like arrangement may not be directly applied in a display panel in delta-like arrangement. Therefore, in this exemplary embodiment, the received original image data in strip-like arrangement is converted into to-be-displayed image data in delta-like arrangement via the mapping converting module 11. The original image data in strip-like arrangement may be RGB image data, or may be RGBW image data or the like, which is not limited in this exemplary embodiment. Each pixel in the display panel in delta-like arrangement includes a red subpixel, a green subpixel and a blue subpixel, such that the RGB image data is preferably selected as the to-be-displayed image data. However, a person skilled in the art may acquire the to-be-displayed image data in other types according to the actual needs. In addition, a person skilled in the art would easily understand that when the original image data has already been arranged in the delta-like manner, the configuration of the mapping converting module 11 may be omitted.

The edge detecting module 12 is connected to the mapping converting module 11, and is mainly configured to receive the to-be-displayed image data in delta-like arrangement, and perform edge detection on the to-be-displayed image data to acquire edge pixels located at an edge of a predetermined type.

In this exemplary embodiment, the Sobel edge detection algorithm is employed by the edge detecting module 12 to perform edge detection on the to-be-displayed image data. The Sobel template is as illustrated in FIGS. 6A to 6B, and the values in FIGS. 6A to 6B represent corresponding weight coefficients of the pixels in a 3×3 region. FIG. 6A illustrates a template in a vertical direction, and FIG. 6B illustrates a template in a horizontal direction.

With respect to the template in the vertical direction:

$$g1(x,y)=|[f(x-1,y+1)+2f(x,y+1)+f(x+1,y+1)]-[f(x-1,y-1)+2f(x+1,y)+f(x+1,y+1)]|;$$

With respect to the template in the horizontal direction:

$$g2(x,y)=|[f(x-1,y+1)+2f(x,y+1)+f(x+1,y+1)]-[f(x-1,y-1)+2f(x,y-1)+f(x+1,y-1)]|;$$

Where, (x, y) represents a central pixel coordinate, f(x, y) represents a luminance value of the pixel corresponding to the coordinate (x, y), and g1(x, y) or g2(x, y) represents a central pixel weight. If g1(x, y)>T, it may be considered that the current central pixel is a pixel at the vertical edge; if g2(x, y)>T, it may be considered that the current central pixel is a pixel at the horizontal edge; and if the direction of the edge is not considered and s(x, y)=g1(x, y)+g2(x, y)>T, it may be considered that the current central pixel is an edge pixel. T is a threshold which is set according to the actual situation.

A weight coefficient in the above Sobel template may be specifically set by a person skilled in the art according to the actual needs. In addition, the edge detecting module 12 may also employ another algorithm, such as the Roberts Cross edge detection algorithm, the line edge detection algorithm, or the like, to perform edge detection on the to-be-displayed image data, which is not limited to the manners described in this exemplary embodiment.

In this exemplary embodiment, the edge of the predetermined type is an edge parallel to an extension direction of the first and second subpixel rows. To be specific, in this exemplary embodiment, the edge of the predetermined type may be an edge in a horizontal direction, for example, an upper horizontal edge and a lower horizontal edge of the image. In addition, an oblique edge and a bending edge may be decomposed into a combination of a plurality of contiguous edges in a horizontal direction and edges in a vertical direction. Therefore, the oblique edges and the bending edges may include a plurality of edges parallel to an extension direction of the first and second subpixel rows, and additionally include a plurality of edges vertical to the extension direction of the first and second subpixel rows. Only the pixels at the edge parallel to the extension direction of the first and second subpixel rows are processed in this exemplary embodiment.

The subpixel selecting module 13 is connected to the edge detecting module 12, and is mainly configured to judge whether the first and second subpixels in the edge pixels are located on an even more outer side at the edge of the predetermined type relative to the third subpixel, and select the first and second subpixels located on the even more outer side at the edge of the predetermined type relative to the third subpixel as to-be-adjusted subpixels.

In this exemplary embodiment, the subpixel selecting module 13 may judge, according to positions of the edge pixels in the pixel matrix and the type of the edge where the edge pixels are located, whether the first and second subpixels in the edge pixels are located at the even more outer side at the edge of the predetermined type relative to the third subpixel. For example, referring to FIG. 7A, in pixel A2 in the second row and the third column in the pixel matrix, the red and green subpixels are located in the third subpixel row, and the blue subpixel is located in the fourth subpixel row; in pixel A3 in the second row and fourth column in the pixel matrix, the red and green subpixels are located in the fourth subpixel row, and the blue subpixel is located in the third subpixel row; in pixel C4 in the fourth row and the fifth column in the pixel matrix, the red and green subpixels are located in the seventh subpixel row, and the blue subpixel is located in the eighth subpixel row; in pixel C5 in the fourth row and the sixth column in the pixel matrix, the red and green subpixels are located in the eighth subpixel row, and the blue subpixel is located in the seventh subpixel row. The edge type may be divided into an upper edge and a lower edge, and the oblique edge and the bending edge may be decomposed into a combination of a plurality of upper edges or a plurality of lower edges.

Figure 7A:
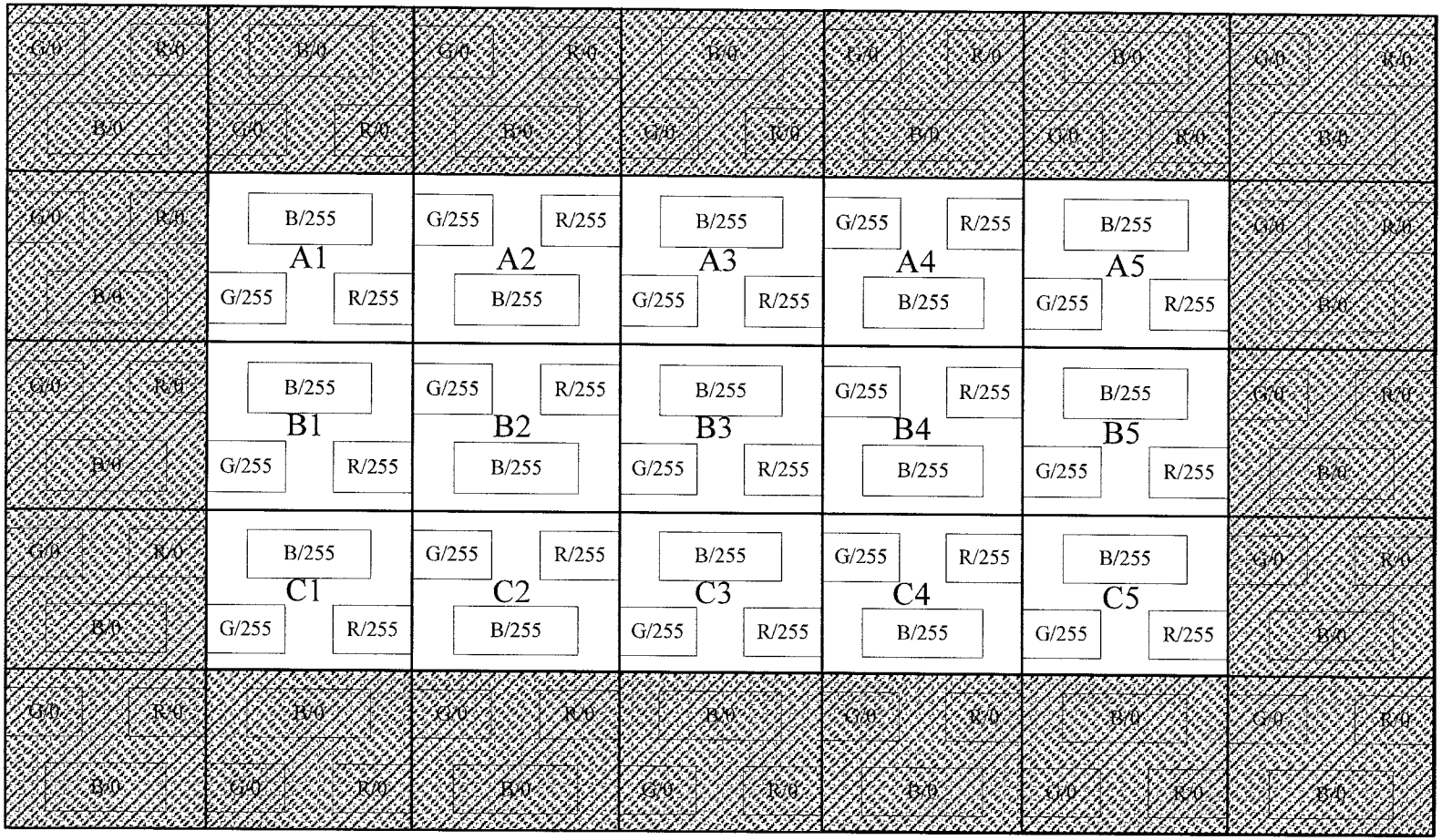
FIG. 7A and FIG. 7B are schematic diagrams of luminance of subpixels before and after image data processing according to an exemplary embodiment of the present disclosure.

For example, referring to FIG. 7A, edges where edge pixels A1 to A5 are located are the upper edges of the image, and edges where edge pixels C1 to C5 are located are the lower edges of the image. When it is judged that edge pixel A2 is located at the upper edge of the image, and in the second row and the third column in the pixel matrix, the red and green subpixels in edge pixel A2 are judged to be located at the even more outer side at the upper edge relative to the blue subpixel, and are selected as to-be-adjusted subpixels; when it is judged that edge pixel A3 is located at the upper edge of the image, and in the second row and the fourth column in the pixel matrix, the red and green subpixels in edge pixel A3 are judged to be located at the even more inner side at the upper edge relative to the blue subpixel, and are not selected as to-be-adjusted subpixels. Analogously, it is judged that the red and green subpixels in edge pixels A4, C1, C3 and C5 are selected as the to-be-adjusted subpixels.

The luminance attenuating module 14 is connected to the subpixel selecting module 13, and is configured to perform luminance attenuation on each edge pixel with the luminance exceeding a predetermined luminance in a comparison result obtained by the subpixel selecting module 13, to obtain to-be-transmitted image data.

Figure 7B:
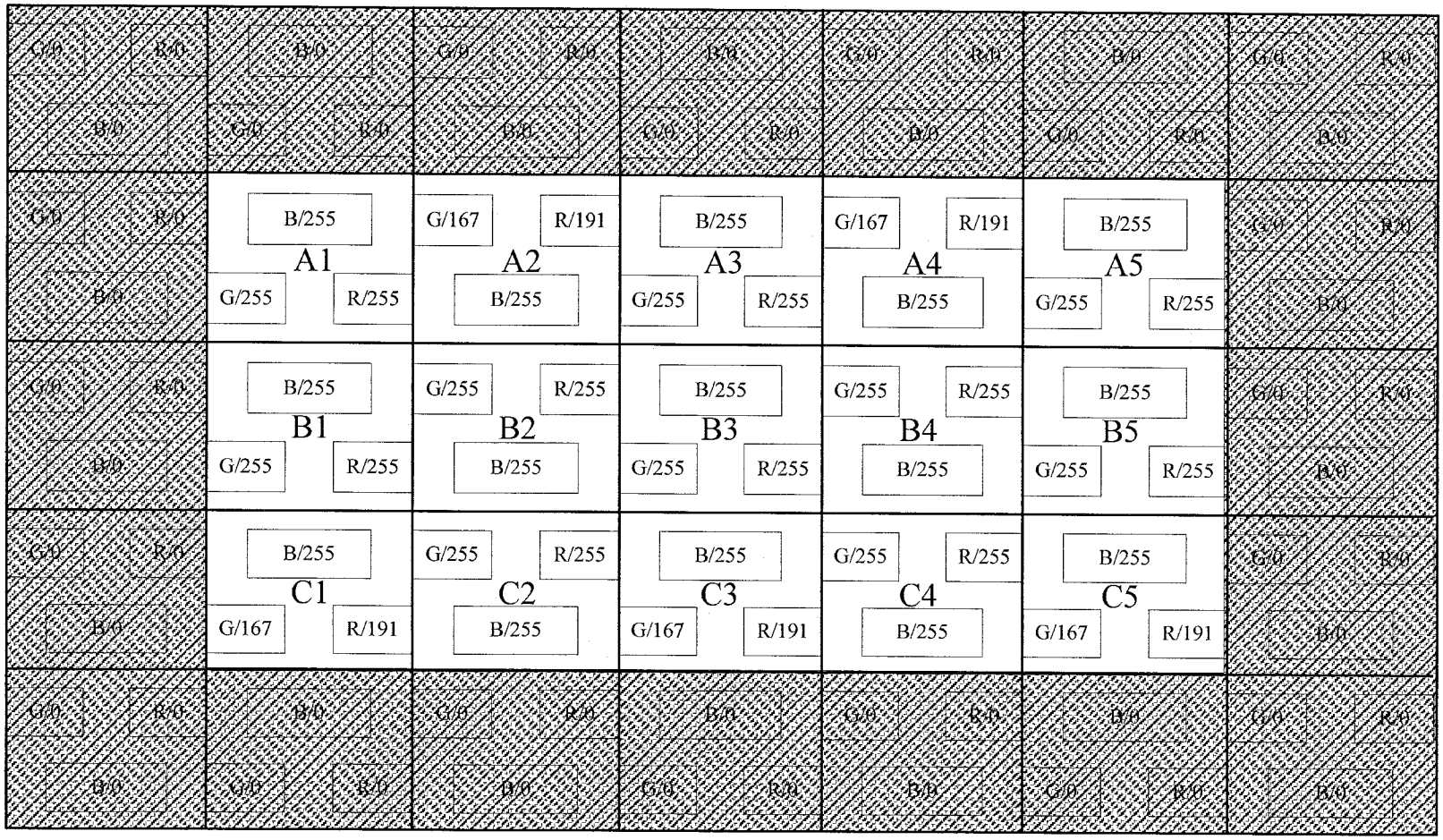

In this exemplary embodiment, the luminance attenuating module 14 may perform luminance attenuation on each to-be-adjusted subpixel according to a predetermined luminance attenuation coefficient, to obtain to-be-transmitted image data. For example, luminance attenuation of a same fixed luminance value is performed on each to-be-adjusted subpixel, or luminance attenuation of different fixed luminance values is performed on each to-be-adjusted subpixel according to different colors. For example, luminance attenuation is performed on the green subpixel by a luminance value which is greater than a luminance value by which luminance attenuation is performed on the red subpixel. Or, the luminance attenuating module 14 may perform luminance attenuation on each to-be-adjusted subpixel according to the predetermined luminance attenuation coefficient, such that different display luminance may be obtained according to different initial luminance of the to-be-adjusted subpixel. In addition, considering the light-emitting efficiency of the red and green subpixels and the aperture opening ratio of the red and green subpixels, in this exemplary embodiment, the predetermined luminance attenuation coefficients of the red and green subpixels are positively correlated to the light-emitting efficiency of the red and green subpixels and the aperture opening ratio of the red and green subpixels. For example, the predetermined luminance attenuation coefficient corresponding to the green subpixel may be greater than the predetermined luminance attenuation coefficient corresponding to the red subpixel. In this exemplary embodiment, the predetermined luminance attenuation coefficient is from 20% to 40%, such as 25%, 29%, 35%, and the like. The obtained to-be-transmitted image data may be as illustrated in FIG. 7B (numbers in FIG. 7 represent luminance values). Nevertheless, a person skilled in the art will easily understand that the predetermined luminance attenuation coefficient may be in other ranges, or may be defined according to other rules.

In this exemplary embodiment, the luminance attenuating module 14 may be implemented via software, for example, via programming by such as C language or VB language. The luminance attenuating module 14 may also be implemented via hardware, for example, via a low pass filter which achieves luminance attenuation on the selected to-be-adjusted subpixel. The implementing manner of the luminance attenuating module 14 is not particularly limited in this exemplary embodiment.

The data transmitting module 15 is connected to the luminance attenuating module 14, and is configured to receive to-be-transmitted image data from the luminance attenuating module 14, and transmit the to-be-transmitted image data to a source driver 20. After the source driver 20 converts the to-be-transmitted image data into data signals, the data signals are inputted through data lines into each column of subpixels in a display panel of delta-like arrangement, and thus the image is displayed.

Figure 8:
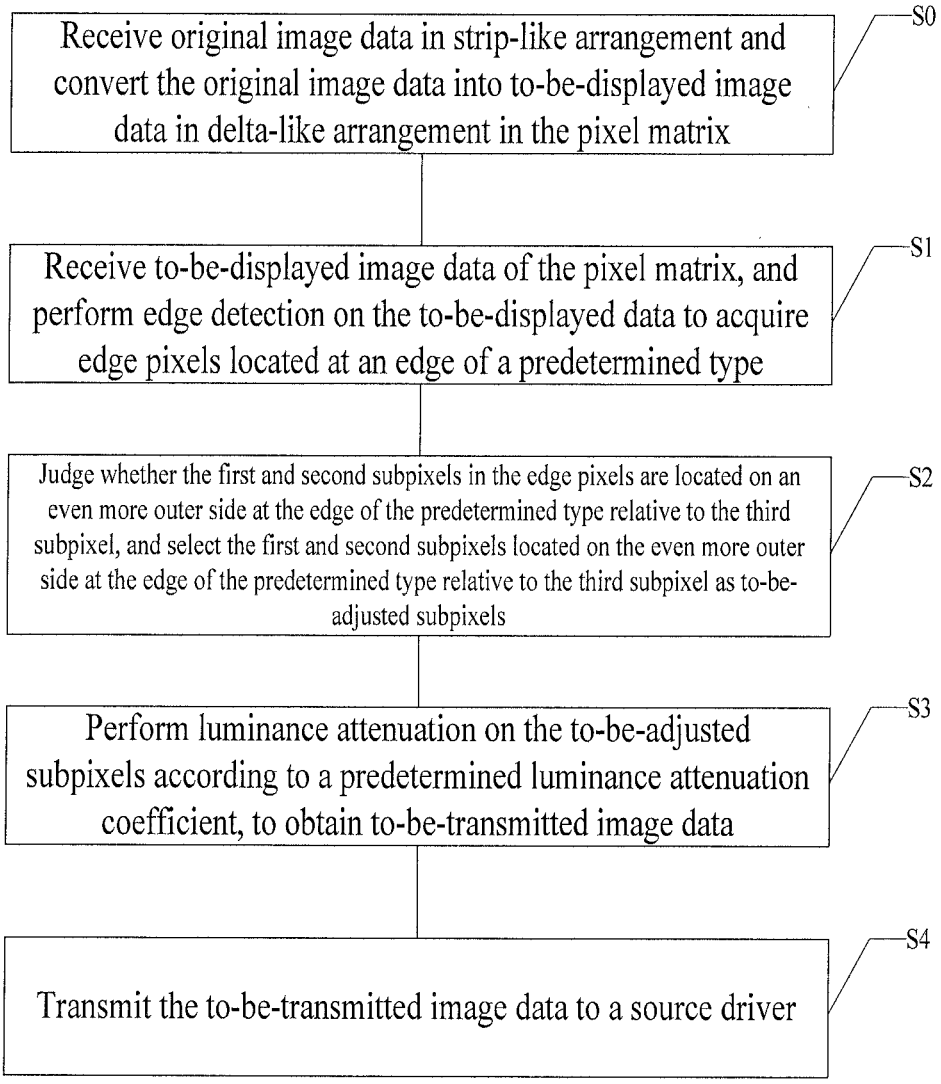
FIG. 8 is a schematic flowchart of an image data processing method according to an exemplary embodiment of the present disclosure.

An exemplary embodiment further provides an image data processing method, applied in a pixel matrix, each pixel in the pixel matrix including a first subpixel and a second subpixel located in a first subpixel row and a third subpixel located in a second subpixel row, wherein each of the first subpixel row and second subpixel row is formed by first to third subpixels aligned repeatedly. As illustrated in FIG. 8, the method may include:

step S1: receiving to-be-displayed image data in the pixel matrix, and performing edge detection on the to-be-displayed data to acquire edge pixels located at an edge of a predetermined type;

step S2: judging whether the first and second subpixels in the edge pixels are located on an even more outer side at the edge of the predetermined type relative to the third subpixel, and selecting the first and second subpixels located on the even more outer side at the edge of the predetermined type relative to the third subpixel as to-be-adjusted subpixels;

step S3: performing luminance attenuation on the to-be-adjusted subpixels according to a predetermined luminance attenuation coefficient, to obtain to-be-transmitted image data; and step S4: transmitting the to-be-transmitted image data to a source driver.

In addition, prior to the step S1, the image data processing method may further include:

step S0: receiving original image data in strip-like arrangement and converting the original image data into to-be-displayed image data in delta-like arrangement in the pixel matrix.

More specific details and detailed description of the above image data processing methods have been illustrated in the corresponding image data processing apparatuses, which is not described herein any further.

Figure 9:
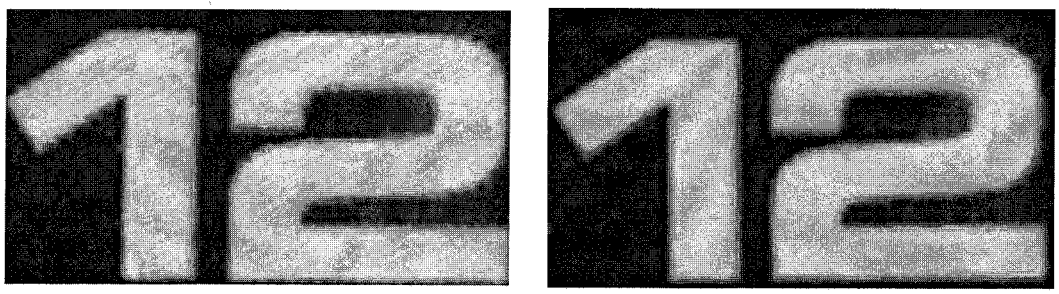
FIG. 9 is a schematic effect diagram of an image data processing solution according to an exemplary embodiment of the present disclosure.

In this exemplary embodiment, the edge pixels located at the edge of the predetermined type in the to-be-displayed image data in delta-like arrangement are extracted, the to-be-adjusted subpixel is selected from the edge pixel, and the luminance of the to-be-adjusted subpixel is adjusted, such that a case where an apparent unsmooth burr sense is caused to the image may be well prevented, and sharpness of image edge display is maintained. For example, FIG. 9 is a schematic diagram of comparison before and after adjustment by image data processing apparatuses or methods of the exemplary embodiments. It may be apparently seen that on the right side of FIG. 9, an unsmooth burr sense of the image after being processed is eliminated, and sharpness of image edge display is maintained. Therefore, a better display quality may be provided by the image data processing apparatuses and methods in this exemplary embodiment.

Furthermore, a display device is provided in an exemplary embodiment. The display device includes the aforesaid image data processing apparatuses. To be specific, the display device may include an OLED display panel or a liquid crystal display panel. The display panel is in delta-like arrangement, and is connected to a source driver. The source driver receives the image data output by the image data processing apparatus. By using the image data processing apparatus, a case where an apparent unsmooth burr sense is caused to the image may be well prevented, and sharpness of image edge display is maintained. Therefore, a better display quality may be provided by the display device in this exemplary embodiment.

The present disclosure has been described with reference to the above embodiments. However, the above embodiments are merely illustrative embodiments for implementing the present disclosure. It should be noted that the disclosed embodiments are not intended to limit the scope of the present disclosure. On the contrary, various modifications and substitutions made without departing from the spirit and scope of the present disclosure shall fall within the protection scope of the present disclosure.

What is claimed is:

1. An image data processing apparatus, applied in a pixel matrix, each pixel in the pixel matrix comprising a first subpixel and a second subpixel located in a first subpixel row and a third subpixel located in a second subpixel row, each of the first subpixel row and second subpixel row being formed by first to third subpixels aligned repeatedly;

wherein the image data processing apparatus comprises:

an edge detecting module, configured to receive to-be-displayed image data in the pixel matrix, and perform edge detection on the to-be-displayed image data to acquire edge pixels located at an edge of a predetermined type;

a subpixel selecting module, configured to judge whether the first and second subpixels in the edge pixels are located on an even more outer side at the edge of the predetermined type relative to the third subpixel, and select the first and second subpixels located on the even more outer side at the edge of the predetermined type relative to the third subpixel as to-be-adjusted subpixels;

a luminance attenuating module, configured to perform luminance attenuation on the to-be-adjusted subpixels according to a predetermined luminance attenuation coefficient, to obtain to-be-transmitted image data; and a data transmitting module, configured to transmit the to-be-transmitted image data to a source driver.

2. The image data processing apparatus according to claim 1, wherein the edge of the predetermined type is an edge parallel to an extension direction of the first and second subpixel rows.

3. The image data processing apparatus according to claim 2, wherein in a pixel in the $m^{th}$ row and the $n^{th}$ column in the pixel matrix, the first and second subpixels are located in the $2m-1^{th}$ subpixel row, and the third subpixel is located in the $2m^{th}$ subpixel row; in a pixel in the $m^{th}$ row and $n+1^{th}$ column in the pixel matrix, the first and second subpixels are located in the $2m^{th}$ subpixel row, and the third subpixel is located in the $2m-1^{th}$ subpixel row; and the subpixel selecting module judges, according to positions of the edge pixels in the pixel matrix and the type of the edge where the edge pixels are located, whether the first and second subpixels in the edge pixels are located at the even more outer side at the edge of the predetermined type relative to the third subpixel.

4. The image data processing apparatus according to claim 1, wherein the image data processing apparatus further comprises:

a mapping converting module, coupled to the edge detecting module, and configured to receive original image data in strip-like arrangement and convert the original image data into to-be-displayed image data in delta-like arrangement in the pixel matrix.

5. The image data processing apparatus according to claim 1, wherein the edge detecting module employs the Sobel edge detection algorithm or the Roberts Cross edge detection algorithm to perform edge detection on the to-be-displayed image data.

6. The image data processing apparatus according to claim 1, wherein the first subpixel is a red subpixel, the second subpixel is a green subpixel, and the third subpixel is a blue subpixel.

7. The image data processing apparatus according to claim 6, wherein the predetermined luminance attenuation coefficient is positively correlated to a light-emitting efficiency of the first subpixel and the second subpixel and an aperture opening ratio of the first subpixel and the second subpixel.

8. The image data processing apparatus according to claim 7, wherein the predetermined luminance attenuation coefficient is from 20% to 40%.

9. A display device, comprising an image data processing apparatus according to claim 1.

10. An image data processing method, applied in a pixel matrix, each pixel in the pixel matrix comprising a first subpixel and a second subpixel located in a first subpixel row and a third subpixel located in a second subpixel row, each of the first subpixel row and second subpixel row being formed by first to third subpixels aligned repeatedly;

wherein the image data processing method comprises:

step S1: receiving to-be-displayed image data in the pixel matrix, and performing edge detection on the to-be-displayed image data to acquire edge pixels located at an edge of a predetermined type;

step S2: judging whether the first and second subpixels in the edge pixels are located on an even more outer side at the edge of the predetermined type relative to the third subpixel, and selecting the first and second subpixels located on the even more outer side at the edge of the predetermined type relative to the third subpixel as to-be-adjusted subpixels;

step S3: performing luminance attenuation on the to-be-adjusted subpixels according to a predetermined luminance attenuation coefficient, to obtain to-be-transmitted image data; and step S4: transmitting the to-be-transmitted image data to a source driver.

11. The image data processing method according to claim 10, wherein the edge of the predetermined type is an edge parallel to an extension direction of the first and second subpixel rows.

12. The image data processing method according to claim 11, wherein in a pixel in the $m^{th}$ row and the $n^{th}$ column in the pixel matrix, the first and second subpixels are located in the $2m-1^{th}$ subpixel row, and the third subpixel is located in the $2m^{th}$ subpixel row; in a pixel in the $m^{th}$ row and $n+1^{th}$ column in the pixel matrix, the first and second subpixels are located in the $2m^{th}$ subpixel row, and the third subpixel is located in the $2m-1^{th}$ subpixel row; and in the step S2, it is judged, according to positions of the edge pixels in the pixel matrix and the type of the edge where the edge pixels are located, whether the first and second subpixels in the edge pixels are located at the even more outer side at the edge of the predetermined type relative to the third subpixel.

13. The image data processing method according to claim 10, wherein prior to the step S1, the image data processing method further comprises:

step S0: receiving original image data in strip-like arrangement and converting the original image data into to-be-displayed image data in delta-like arrangement in the pixel matrix.

14. The image data processing method according to claim 10, wherein in the step S1, the Sobel edge detection algorithm or the Roberts Cross edge detection algorithm is employed to perform edge detection on the to-be-displayed image data.

15. The image data processing method according to claim 10, wherein the first subpixel is a red subpixel, the second subpixel is a green subpixel, and the third subpixel is a blue subpixel.

16. The image data processing method according to claim 15, wherein the predetermined luminance attenuation coefficient is positively correlated to a light-emitting efficiency of the first subpixel and the second subpixel and an aperture opening ratio of the first subpixel and the second subpixel.

17. The image data processing method according to claim 16, wherein the predetermined luminance attenuation coefficient is from 20% to 40%.

* * * * *